United States Patent [19]

Mosquera

[11] Patent Number: 4,975,076

[45] Date of Patent: Dec. 4, 1990

[54] CONTACT WIPING ELECTRICAL CONNECTOR

[75] Inventor: Rene Mosquera, Elk Grove Village, Ill.

[73] Assignee: Molex Incorporated, Lisle, Ill.

[21] Appl. No.: 486,682

[22] Filed: Mar. 1, 1990

[51] Int. Cl.[5] ..... H01R 4/24

[52] U.S. Cl. ..... 439/387; 439/465

[58] Field of Search ..... 495/387, 389–426, 495/465, 466, 467

[56] References Cited

U.S. PATENT DOCUMENTS

| | | | |
|---|---|---|---|
| 3,170,749 | 2/1965 | Johanson et al. | 439/465 |
| 3,858,160 | 12/1974 | Denton | 439/465 |
| 4,153,326 | 5/1979 | Frantz et al. | 439/465 |
| 4,413,872 | 11/1983 | Rudy, Jr. et al. | 439/397 |

*Primary Examiner*—Joseph H. McGlynn

*Attorney, Agent, or Firm*—Louis A. Hecht; Stephen Z. Weiss; Charles S. Cohen

[57] ABSTRACT

An electrical connector for making connection to a conductor cable, including a connector block which has an anvil surface against which the conductor cable is positionable. A resilient electrical contact member is fixed to the connector block and has an abutment portion for engaging the conductor cable opposite the anvil surface. The electrical contact terminates in a free end extending angularly at an acute angle away from the abutment portion and the anvil surface. A cover member has an inner contact engaging surface and is affixed to the connector block in a direction of movement transverse to the anvil surface. The inner surface of the cover member engages the free end of the contact member to drive the abutment portion of the contact member into engagement with the conductor cable. The abutment portion is caused to wipe the conductor cable due to the angular orientation of the free end of the contact member. The conductor cable is inserted into the connector with zero insertion force, and the cover member and connector block provide strain relief on the cable.

26 Claims, 3 Drawing Sheets

CONTACT WIPING ELECTRICAL CONNECTOR

FIELD OF THE INVENTION

This invention generally relates to electrical connectors and, particularly, to an electrical connector which effects wiping engagement between a contact member and a conductor cable, with cable strain relief and zero insertion force features.

BACKGROUND OF THE INVENTION

Many electrical connectors are designed to have a contact with a contact surface pressed against an electrical conductor cable under spring force inherent in the flexibility of the contact itself. Often, it is desirable to effect a "wiping" action between the contact and the conductor whereby the contact surface is wiped along the conductor, as a result of which contaminants on the mating surfaces are removed. This often is accomplished by providing the connector with a two-part housing, such as a connector block and a cover member, wherein the cover member is affixed to the connector block by a sliding action or by a swiveling action. Swiveling-type constructions are quite cumbersome and do not lend themselves to a very compact package. Sliding constructions usually effect a sliding action between the cover member and the connector block generally parallel to or oblique to the wiping action of the contact surfaces and, consequently, the wiping forces are not considerable in a direction normal to the surfaces. For instance, in some applications, not only is it desirable to remove contaminants by the wiping action, but a substantially gas-tight connection is desired, and such connectors cannot provide sufficient normal forces to effect that tight of a connection.

These types of connectors often are useful for flexible flat conductor cables which carry a multiplicity of individual conductors parallel to each other in a common plane. Flat conductor cables often are used in printed circuit board applications or the like and, consequently, have other specified design criteria.

For instance, it is desirable to provide strain relief on the cable to secure the cable in extreme environmental conditions and to prevent any possible intermittent operation or failure of the circuits.

In addition, it is desirable to insert the cables into the connectors with zero insertion force. This often is provided by extensions on the flexible contacts or by the use of specialized tools to raise the spring-loaded contacts from the mating surfaces of the connector block or cover.

Combining all of these features into a single connector creates considerable problems and dilemmas when it is desirable to provide a very compact connector for use in confined environments or simply to reduce the cost and complexity of the connector construction. This invention is directed to solving these problems by providing an electrical connector which effects a wiping action between a contact and the cable with high normal contact forces, while providing strain relief for the cable and zero insertion force for inserting the cable into proper position in the connector.

SUMMARY OF THE INVENTION

An object, therefore, of the invention is to provide a new and improved electrical connector providing contact wiping action, cable strain relief and zero insertion force features.

In the exemplary embodiment of the invention, a connector block has an anvil surface against which a conductor cable is positionable. At least one resilient electrical contact member is fixed to the connector block and has an abutment portion for engaging the conductor cable opposite the anvil surface. The contact member terminates in a free end extending angularly away from the abutment portion and the anvil surface. A cover member has an inner contact engaging surface thereon. The cover member and connector block include means for affixing the cover member to the connector block in a direction of movement transverse to the anvil surface. The inner surface of the cover member engages the free end of the contact member to drive the abutment portion of the contact member into engagement with the conductor cable which, in turn, drives the conductor cable into engagement with the anvil surface of the connector block. The abutment portion of the contact member is caused to wipe the conductor cable due to the angular orientation of the free end of the contact member.

As disclosed herein, the free end of the contact member extends at an acute angle to the direction of movement of the cover member to provide high contact engaging and wiping forces. The abutment portion of the contact member is formed by a reverse bend in the contact member, with the free end extending angularly away from one side of the abutment portion and an intermediate spring portion of the contact member extending away from an opposite side of the abutment portion. The inner contact engaging surface on the cover member includes stop means to prevent a distal end portion of the free end of the contact member from moving transverse to the direction of movement of the cover member when affixed to the connector block.

The connector includes strained relief means in the form of a recess in one of the connector block and cover member and a detent on the other of the connector block and cover member for bending the conductor cable into the recess, again as a function of affixing the cover member to the connector block and without in any way enlarging the compact size of the connector construction.

Still further, the means for affixing the cover member to the connector block include means for positioning and retaining the cover member in a first position with the abutment portion of the contact member spaced from the anvil surface of the connector block. This allows insertion of the conductor cable with zero insertion force. In a second position, the abutment portion of the contact member is driven into engagement with the conductor cable, thereby avoiding any extraneous special tools or extensions of the contact member itself.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
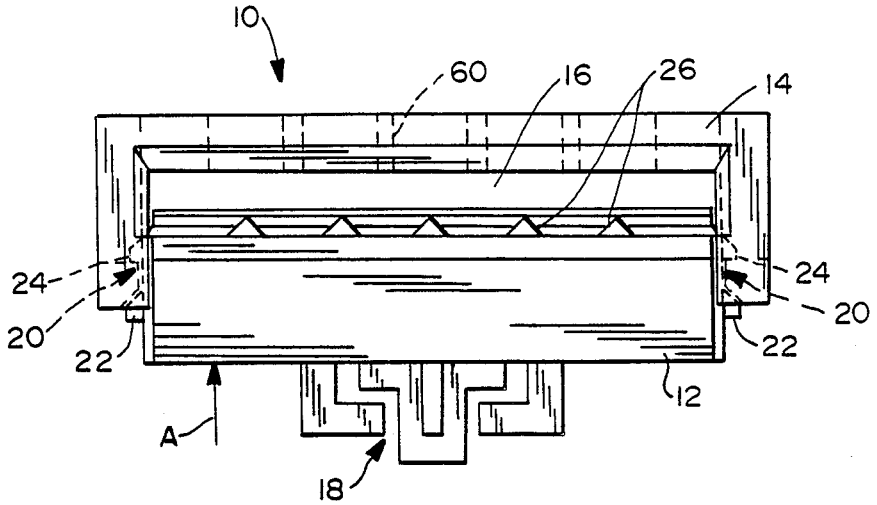
FIG. 1 is an elevational view of the insertion end of an electrical connector embodying the concepts of the invention, with the cover member in a cable-loading position relative to, the connector block.
Figure 2:
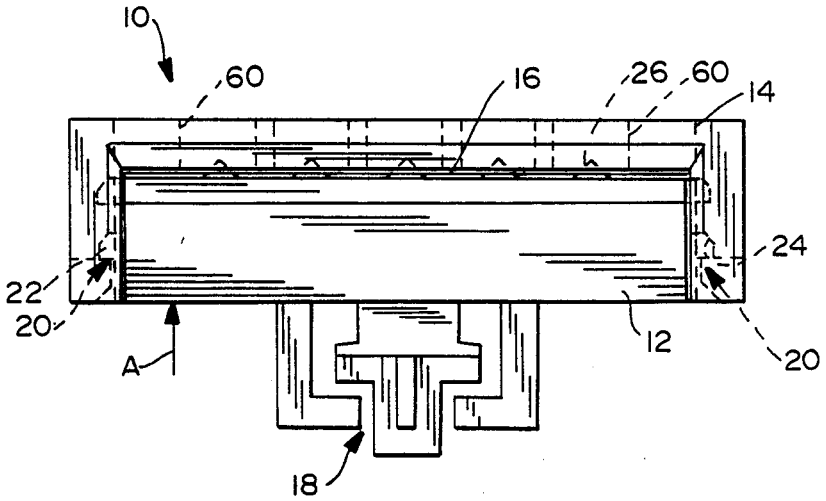
FIG. 2 is a view similar to that of FIG. 1, with the cover member in a locked position affixed to the connector block.

Referring to the drawings in greater detail, and first to FIGS. 1 and 2, an electrical connector, generally designated 10, is shown to have a generally flat profile for terminating a flexible flat conductor cable which carries a multiplicity of individual conductors aligned in parallel, such as is often used to provide connections to printed circuit boards or the like. The connector includes a cover member 12 and a connector block 14 defining a narrow slot or opening 16 therebetween for receiving the terminating end of a flat conductor cable. A standard "G" latch, generally designated 18, is formed integrally with block 14 (as better seen in FIGS. 4 and 5) for mating with a complementary male connector.

Electrical connector 10 is designed with a zero insertion force feature for inserting the flat conductor cable into opening 16. To that end, connector block 14 and cover member 12 have a two-step locking means, generally designated 20, on each opposite side thereof. Each locking means 20 includes a pair of camming/locking tabs 22 projecting outwardly from the respective side of cover 12. Connector block 14 has pairs of complementarily shaped interior recesses 24 on the inside thereof for receiving one or both of locking tabs 22. It can be seen that the inner (upper as viewed in the drawings) edges of locking tabs 22 are angled or chamfered to provide a camming action to spread the walls of connector block 14 so that the tabs can snap into recesses 24. To that end, the connector block and the cover member both are molded integrally of plastic material.

With the structure described immediately above, it can be seen in FIG. 1 that the first (upper as viewed in the drawings) locking tabs 22 on opposite sides of cover 12 have been snapped into the first (or lower) recesses in connector block 14. This defines a loading position of the cover relative to the connector block to allow a flat cable to be inserted into opening 16 with zero insertion force, as described further hereinafter. Once the cable is inserted, cover 12 is moved in the direction of arrow "A" toward or relative to connector block 14 until both locking tabs 22 on opposite sides of the cover lock into recesses 24 to define a locked position for the cover and connector block wherein termination is made to the conductors of the flat cable and strain relief is provided on the cable, as described in greater detail hereinafter. Suffice it to say at this point, FIGS. 1 and 2 show a plurality of strain relief detents 26 which extend into or across opening 16 into which the cable is inserted.

Figure 3:
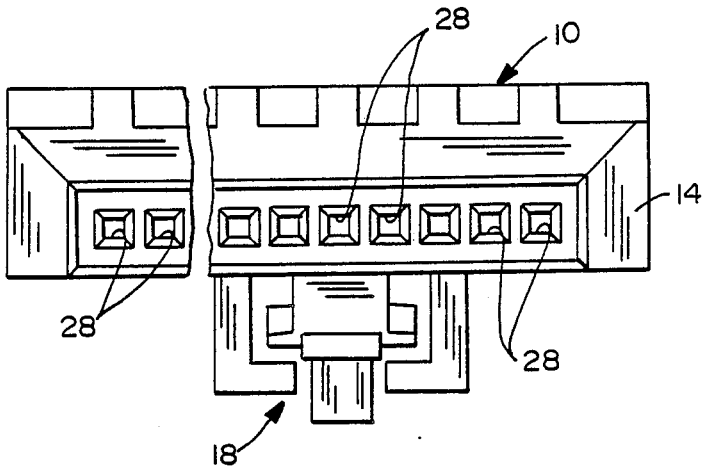
FIG. 3 is an end elevational view of the mating end of the connector, opposite that of FIGS. 1 and 2.

FIG. 3 simply shows the mating end of electrical connector 10, opposite the insertion end of FIGS. 1 and 2, to show a row or series of openings 28 for receiving male contacts of a complementary male connector. In other words, connector 10 illustrated and described herein comprises a female connector, but it should be understood that the novel features of the invention equally are applicable and useful for the mating male connector. The difference simply would be in the construction of the mating ends of the contacts, as described hereinafter.

Figure 4:
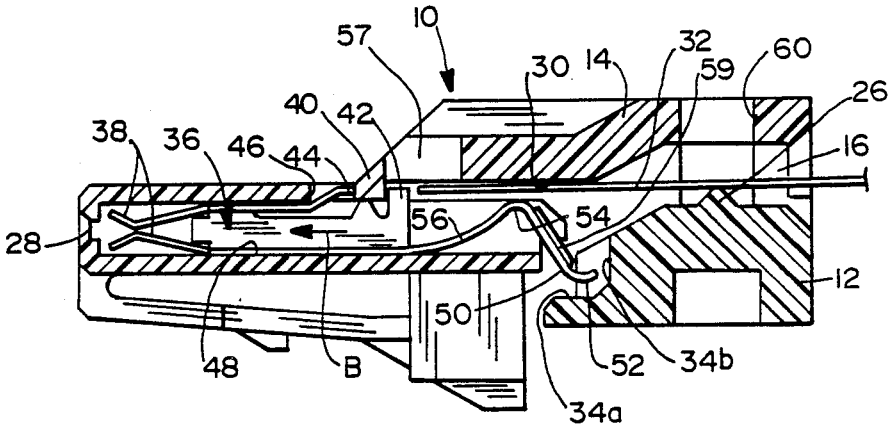
FIG. 4 is a vertical section through the connector in the loading position of FIG. 1.
Figure 5:
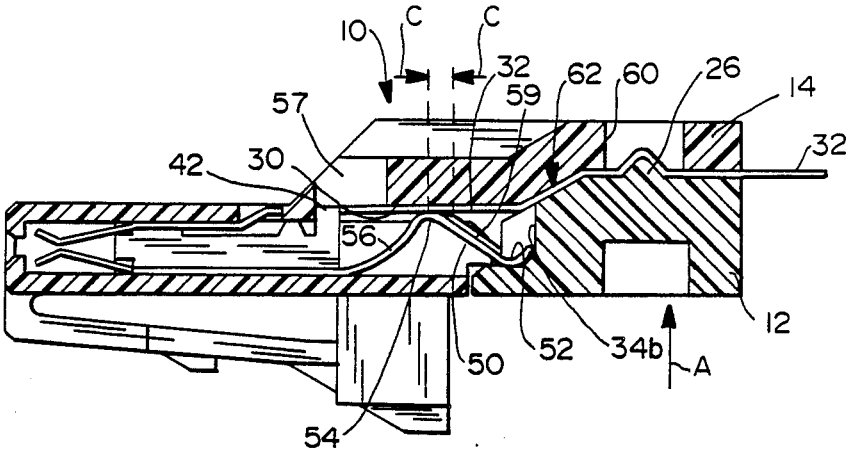
FIG. 5 is a vertical section through the connector in the locked position of FIG. 2.

Referring to FIGS. 4 and 5, the interior of electrical connector 10 is shown to illustrate the novel contact wiping and strain relief features. FIG. 4 shows connector block 14 and cover 12 in their relative loading positions corresponding to FIG. 1, and FIG. 5 shows the connector block and cover in their relative locking positions corresponding to FIG. 2. Connector block 14 has an anvil surface 30 against which a conductor cable 32, such as a multi-conductor flat cable, is positionable. Cover 12 has inner contact engaging surface means 34*a* and 34*b* on the inside thereof. A resilient electrical contact member, generally designated 36, is fixed to or within connector block 14. In the exemplary electrical connector embodiment illustrated herein, a plurality of electrical contacts 36 are provided, one for each opening or receptacle 28 (FIG. 3) for mating with a complementary male contact plug of a mating male connector. To this end, opposed spring beams 38 are provided immediately inside the respective opening 28 and between which the respective male contact plug is inserted. The entire contact member is a stamped and formed structure.

Each contact member 36 is fixed to the connector block by means of engagement with opposite sides of an internal boss 40 of the connector block. The contact is inserted or assembled into the connector block from the right as viewed in the drawings, i.e. in the direction of arrow "B" in FIG. 4, until a stop 42 on the contact engages the right-hand side of boss 40. At this positional point, a flexible spring tongue 44 which was biased inwardly by boss 40, snaps into a recess 46 against the opposite side of the boss. Therefore, the contact is rigidly fixed within the connector block against movement in either longitudinal direction, and the contact, at its mating end, substantially conforms to the size and shape of an interior bore 48 of the connector block to prevent any lateral movement The end of each contact 36, opposite mating end 38, is formed as a leaf spring-type structure. Specifically, the contact terminates in a free end 50 which has a curved distal end portion 52. Free end 50 extends angularly away from one side of an abutment portion 54 which is formed by a reverse bend in the contact. An intermediate spring portion 56 extends angularly away from the opposite side of abutment portion or reverse bend 54. Therefore, it can be seen that abutment portion 54 is in juxtaposition with anvil surface 30 on the inside of connector block 14, and distal portion 52 of free end 50 is in juxtaposition with engaging surface means 34*a*,34*b* on the inside of cover 12. In the loading position shown in FIG. 4, it can be seen that abutment portion 54 is spaced away from anvil surface 30 whereby conductor cable 32 can be inserted therebetween, through opening 16, with zero insertion force. A visual inspection window, generally designated 57, is provided in block 14 to make sure that flat conductor 32 is in proper lateral registration with abutment portion 54 of contact 36. The window affords observation to ensure that abutment portion 54 will be in contact with the conductor (not shown) in conductor cable 32 when cover 12 is forced in the direction of arrow "A", and that conductor cable 32 is in proper longitudinal registration or having proper depth of insertion; i.e., that the forward end of the conductor contacts stop 42 (see FIG. 5) of terminal 36.

Once conductor cable 32 is inserted into the connector with the connector block and cover in their relative loading positions, the position of conductor 32 is visually ascertained through window 57 and, if properly aligned with contact abutment portion 54, the cover is forced in the direction of arrow "A" (FIG. 5) until the cover is locked to the connector block as described in relation to FIGS. 1 and 2, utilizing locking tabs 22 and recesses 24. This locked position is shown in FIG. 5, and it can be seen that the cover is affixed to the connector block in a direction of movement transverse or perpendicular to anvil surface 30 of the connector block. During locking movement, contact engaging surface means **34*a*,34*b* on the inside of cover 12 engage distal end portion 52 of the contact. In essence, contact engaging surface 34*a* biases the distal end portion toward the connector block transverse or perpendicular to anvil surface 30, and contact engaging surface 34*b* forms a stop means to prevent lateral movement of the distal end portion, i.e longitudinally of the contact member or toward the right in the drawings With the very tip of the contact thereby constrained against movement, abutment portion 54 not only is driven against conductor cable 22 and, in turn, the conductor cable against anvil surface 30, but the abutment portion is caused to slide inwardly or to the left in the drawings effecting a wiping action against the conductor to remove any contaminants between the conductive engaging surfaces. The contact "wipe" is generally indicated by the distance represented by arrows "C" (FIG. 5). Still further, it is desirable to provide a gas tight connection between abutment portion 54 and the conductor cable, which requires considerable force. To this end, a stiffening rib 59 is formed integral with free end 50 of the contact 36 and prevents the free end from bending. Closing forces from cover member 12 are directed linearly along the free end of the contact, literally driving abutment portion 54** against the conductor cable with considerable force.

The configuration of contact 36 not only effects a wiping action on the conductor cable, but a high spring force is applied to the cable to maintain a gas-tight connection between the contact and the conductor. The high force is effected by a combination of the acute angle of free end 50, and the opposing spring force of intermediate portion 56 of the contact configuration, in combination with the normal forces applied by the cover.

More particularly, it can be seen in FIG. 4 that free end 50 of the contact extends at an acute angle to the direction of movement of cover 12, i.e. movement perpendicular to anvil surface 30 and the conductor cable itself It can be seen in FIG. 5 that the free end actually remains straight and at an angle in the locked condition of the connector, thereby maintaining a strong bias against the conductor. In addition, intermediate spring portion 56 of the contact, on the opposite side of conductor abutment portion 54, continuously opposes the movement to provide a reaction force driving the abutment portion against the conductor cable. This can be seen by comparing FIG. 4 with FIG. 5 wherein it can be seen that intermediate portion 56 is bent considerably in the locked condition of the connector, thereby maintaining a tight connection between abutment portion 54 and the conductor cable.

Detents 26 described briefly in relation to FIGS. 1 and 2, also are shown in FIGS. 4 and 5 in alignment with recesses 60 in connector block 14, i.e. in line with the direction of locking movement of the cover relative to the connector block. When the cover is moved to its locked position, detents 26 force the conductor cable into recesses 60 and actually form bends in the cable. A strain relief thereby is provided to prevent the cable from being pulled rearwardly outwardly of the locked connector. Preferably, the inside mating contours of connector block 14 and cover 12 are such as to provide an irregular path, as indicated generally at 62 in FIG. 5, to further provide a strain relief function. Lastly, conductor cable 32 is stripped of its insulating cladding or coating somewhere between strain relief detents 26 and abutment portion 54 of contact 36 so that the abutment portion engages a bare conductor and the strain relief detents engage the plastic cladded cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for making connection to a conductor cable, comprising:

a connector block having an anvil surface against which a conductor cable is positionable;

at least one resilient electrical contact member fixed to the connector block and having an abutment portion for engaging the conductor cable opposite the anvil surface, the contact member terminating in a free end extending angularly from the abutment portion and anvil surface; and a cover member having inner contact engaging surface means thereon, the cover member and connector block including means for affixing the cover member to the connector block in a direction of movement transverse to the anvil surface, with the inner surface of the cover member engaging the free end of the contact member to drive the abutment portion of the contact member into engagement with the conductor cable and, in turn, the conductor cable into engagement with the anvil surface, the abutment portion being caused to wipe the conductor cable due to the angular orientation of the free end of the contact member.

2. The electrical connector of claim 1 wherein said free end of the contact member extends at an acute angle to the direction of movement of the cover member.

3. The electrical connector of claim 1 wherein said inner contact engaging surface means on the cover member include stop means to prevent a distal end portion of the free end of the contact member from moving transverse to said direction of movement.

4. The electrical connector of claim 1 wherein said means for affixing the cover member to the connector block include means for positioning and retaining the cover member in a first position with the abutment portion of the contact member spaced from the anvil surface to allow insertion of the conductor cable with zero force and a second position wherein the abutment portion is driven into engagement with the conductor cable.

5. The electrical connector of claim 1 wherein said abutment portion of the contact member comprises a reverse bend in the contact member, with the free end of the contact member extending angularly away from one side of the abutment portion and an intermediate spring portion of the contact member extending away from an opposite side of the abutment portion.

6. The electrical connector of claim 5 wherein said free end of the contact member extends at an acute angle to the direction of movement of the cover member.

7. The electrical connector of claim 6 wherein the connector block has a stiffening rib for engagement by the free end of the contact member to prevent the free end from bending.

8. The electrical connector of claim 1, including complementary strain relief means between the connector block and the cover member for operatively engaging the conductor cable when the cover member is affixed to the connector block.

9. The electrical connector of claim 8 wherein said strain relief means include a recess in one of the connector block and cover member and a detent on the other of the connector block and cover member for bending the conductor cable into the recess.

10. An electrical connector for making connection to a conductor cable, comprising:

a connector block having an anvil surface against which a conductor cable is positionable;

at least one resilient electrical contact member fixed to the connector block and having an abutment portion for engaging the conductor cable opposite the anvil surface, the contact member terminating in a free end extending angularly from the abutment portion and anvil surface;

a cover member having inner contact engaging surface means thereon, the cover member and connector block including means for affixing the cover member to the connector block in a first position with the abutment portion of the contact member spaced from the anvil surface to allow insertion of the conductor cable with zero force and for moving the cover member in a direction transverse to the anvil surface to a second position wherein an inner surface of the cover member engages the free end of the contact member and drives the abutment portion into engagement with the conductor cable and, in turn, the conductor cable into engagement with the anvil surface, the abutment portion being caused to wipe the conductor cable due to the angular orientation of the free end of the contact member; and complementary strain relief means between the connector block and the cover member for operatively engaging the conductor cable when the cover member and the connector block are in said second position.

11. The electrical connector of claim 10 wherein said free end of the contact member extends at an acute angle to the direction of movement of the cover member.

12. The electrical connector of claim 11 wherein the free end of the contact member has a stiffening rib to prevent the free end from bending.

13. The electrical connector of claim 10 wherein said abutment portion of the contact member comprises a reverse bend in the contact member, with the free end of the contact member extending angularly away from one side of the abutment portion and an intermediate spring portion of the contact member extending away from an opposite side of the abutment portion.

14. The electrical connector of claim 13 wherein said free end of the contact member extends at an acute angle to the direction of movement of the cover member.

15. The electrical connector of claim 10 wherein said inner contact engaging surface means on the cover member include stop means to prevent a distal end portion of the free end of the contact member from moving transverse to said direction of movement.

16. The electrical connector of claim 15 wherein said strain relief means include a recess in one of the connector block and cover member and a detent on the other of the connector block and cover member for bending the conductor cable into the recess.

17. An electrical connector for making connection to a conductor cable, comprising:

a connector block having an anvil surface against which a conductor cable is positionable;

a cover member having inner contact engaging surface means thereon, the cover member and connector block including means for affixing the cover member to the connector block in a direction of movement transverse to the anvil surface;

at least one resilient electrical contact member fixed to the connector block and having an abutment portion formed by a reverse bend in the contact member for engaging the conductor cable opposite the anvil surface, the free end of the contact member extending at an acute angle to the direction of movement of the cover member away from one side of the abutment portion, with an intermediate spring portion of the contact member extending away from an opposite side of the abutment portion; and stop means on the cover member to prevent a distal end portion of the free end of the contact member from moving transverse to said direction of movement.

18. The electrical connector of claim 17 wherein said means for affixing the cover member to the connector block include means for positioning and retaining the cover member in a first position with the abutment portion of the contact member spaced from the anvil surface to allow insertion of the conductor cable with zero force and a second position wherein the abutment portion is driven into engagement with the conductor cable.

19. The electrical connector of claim 17, including complementary strain relief means between the connector block and the cover member for operatively engaging the conductor cable when the cover member is affixed to the connector block.

20. The electrical connector of claim 19 wherein said strain relief means include a recess in one of the connector block and cover member and a detent on the other of the connector block and cover member for bending the conductor cable into the recess.

21. An electrical connector for making connection to a conductor cable, comprising:

a connector block having an anvil surface against which a conductor cable is positionable;

a cover member positionable on the connector block in a direction of movement generally perpendicular to said anvil surface and including a contact engaging surface; and at least one resilient electrical contact member fixed to the connector block and having a free end engageable by said contact engaging surface, the contact member being shaped such that a portion thereof wipes the conductor cable in a direction generally parallel to said anvil surface in response to positioning the cover member onto the connector block in said direction generally perpendicular to the anvil surface.

22. The electrical connector of claim 21, including complementary strain relief means between the connector block and the cover member for operatively engaging the conductor cable when the cover member is affixed to the connector block.

23. The electrical connector of claim 21 including means for affixing the cover member to the connector block for positioning and retaining the cover member in a first position with said portion of the contact member spaced from the anvil surface to allow insertion of the conductor cable with zero force and a second position wherein said portion of the contact member is driven into engagement with the conductor cable.

24. The electrical connector of claim 21, including a visual inspection window in one of the connector block and the cover and located to afford visualization of the conductor cable relative to said portion of the contact member.

25. The electrical connector of claim 21 wherein said free end of the contact member extends at an acute angle to the direction of movement of the cover member.

26. The electrical connector of claim 25 wherein the free end of the contact member has a stiffening rib to prevent the free end from bending.

* * * * *